US005551905A

United States Patent [19]

Billings et al.

[11] Patent Number: 5,551,905

[45] Date of Patent: Sep. 3, 1996

[54] SUCCESSIVE IMAGE DISPLAY DEVICE

[76] Inventors: Zeb Billings, 5392 N. Hwy. 83, Hartland, Wis. 53029; Michael Henning, 6040 Blvd. East, West New York, N.J. 07093

[21] Appl. No.: 195,483

[22] Filed: Feb. 14, 1994

[51] Int. Cl.[6] ..... A63H 33/38; A63H 33/30

[52] U.S. Cl. ..... 446/151; 40/491; 446/408

[58] Field of Search ..... 446/151, 82, 147, 446/149, 151, 152, 397, 408, 404; 40/491, 500, 508, 448; 352/81, 58, 98, 99, 100, 70; 434/317

[56] References Cited

U.S. PATENT DOCUMENTS

| | | | |
|---|---|---|---|
| 1,126,645 | 1/1915 | LoRentz | 352/99 |
| 2,197,268 | 4/1940 | Gold | 352/99 |
| 3,080,668 | 3/1963 | Reali | 40/491 X |
| 3,102,350 | 9/1963 | Dixon | 40/491 |
| 3,106,029 | 10/1963 | Desmond . | |
| 3,228,742 | 1/1966 | Hand . | |
| 3,553,851 | 1/1971 | Paige . | |
| 3,613,277 | 10/1971 | Rose et al. | 40/491 X |
| 3,659,367 | 5/1972 | Yumoto | 40/491 |
| 4,664,634 | 5/1987 | Cutler et al. . | |
| 4,809,453 | 3/1989 | Morgan | 40/491 X |
| 4,837,957 | 6/1989 | Egender | 40/491 X |
| 4,990,092 | 2/1991 | Cummings . | |

OTHER PUBLICATIONS

Operative Page of Hidden Animals.

*Primary Examiner*—Robert A. Hafer
*Assistant Examiner*—D. Neal Muir
*Attorney, Agent, or Firm*—Amster, Rothstein & Ebenstein

[57] ABSTRACT

A device for successively displaying a plurality of images includes a plurality N of overlying panels where N is at least 3. Each of the panels defines a longitudinal series of flexible slats and louvers between the slats, the slats being longitudinally longer than the louvers. Each of the slats of all underlying panels are interleaved longitudinally through the louvers of all overlying panels, the slats of each panel cooperatively defining one of the plurality of images. Each of the slats of an overlying panel is laterally narrower than the slats of all underlying panels. A knob is provided for moving in turn each of a subplurality N−1 of the plurality of panels a length at least equal to the length of a louver such that movement of a given panel in one longitudinal direction exposes the slats of an adjacently overlying panel and conceals the slats of the given panel underneath the slats of an underlying panel, and movement of the given panel in the opposite longitudinal direction exposes the slats of the given panel and conceals the slats of an adjacently overlying panel under the slats of the given panel.

12 Claims, 17 Drawing Sheets

FIG. 1
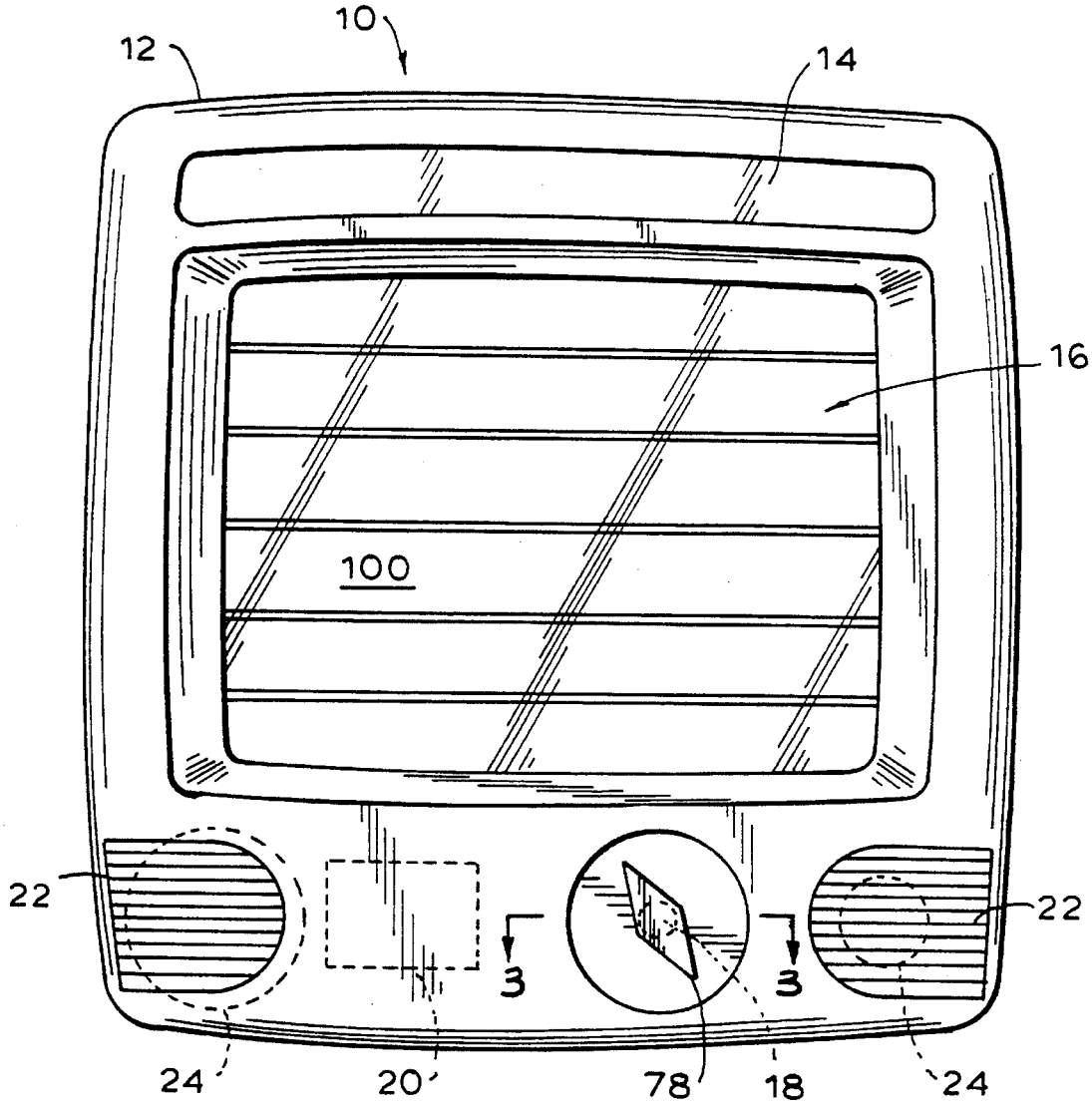
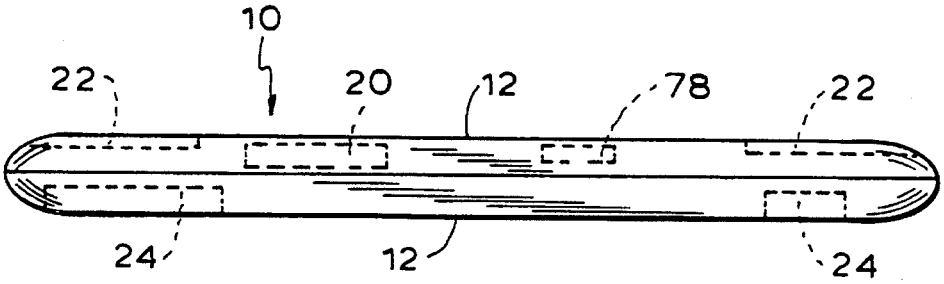
FIG. 2

FIG. 7
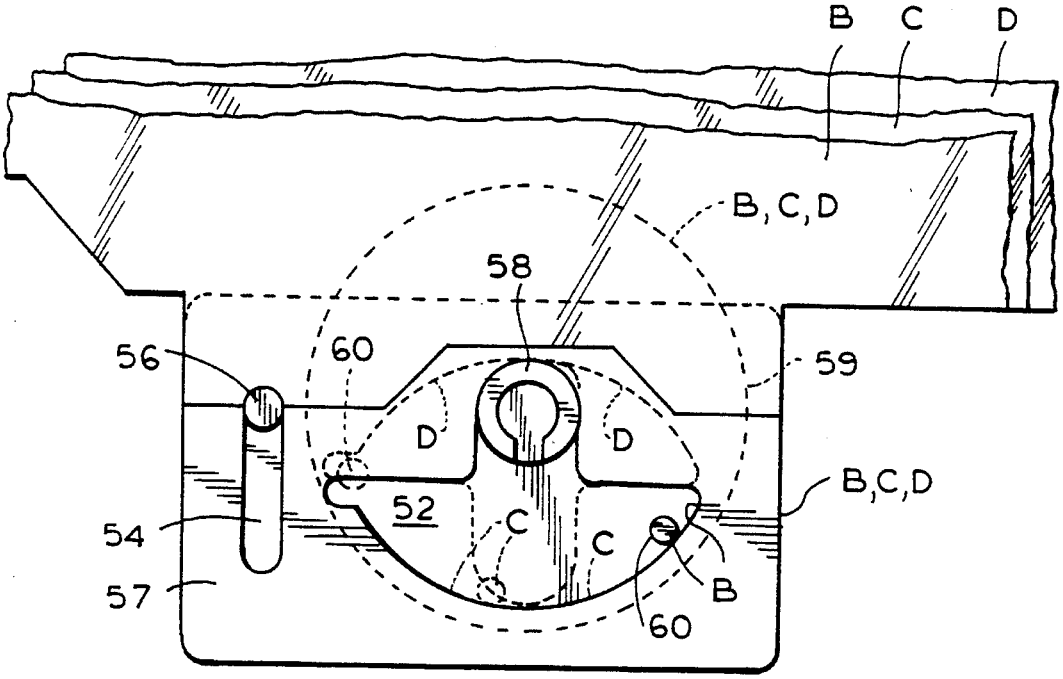
POS#1
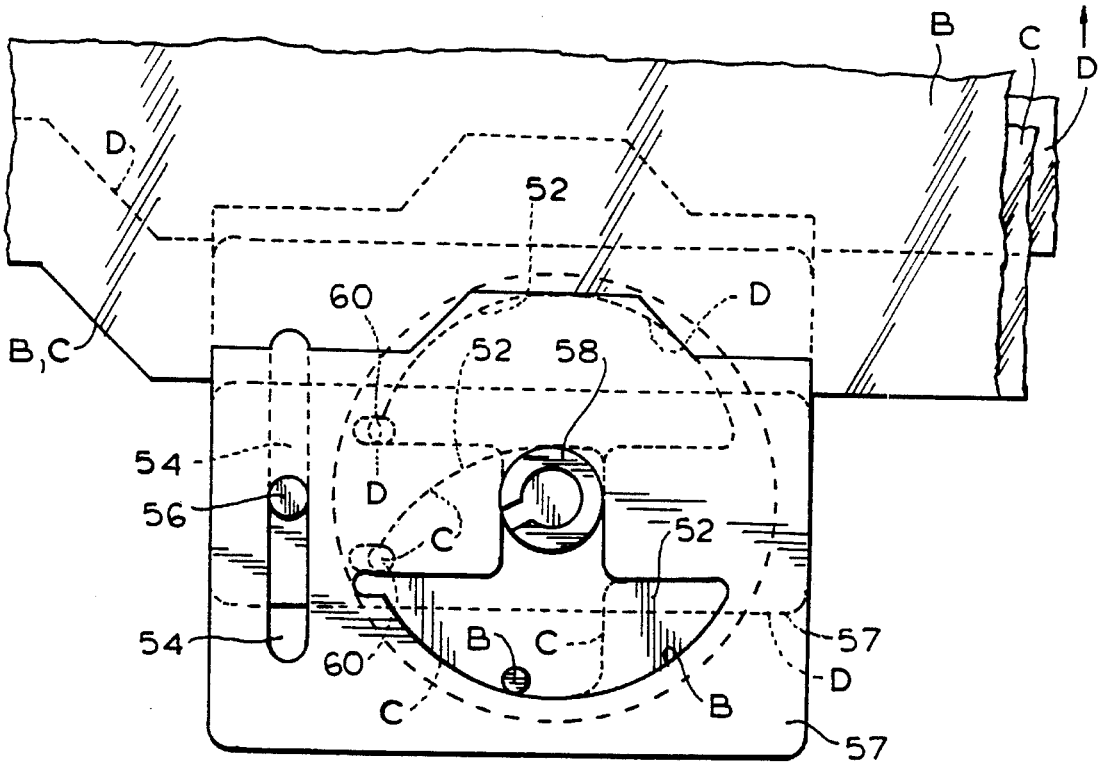
POS#2
FIG. 8

FIG. 9
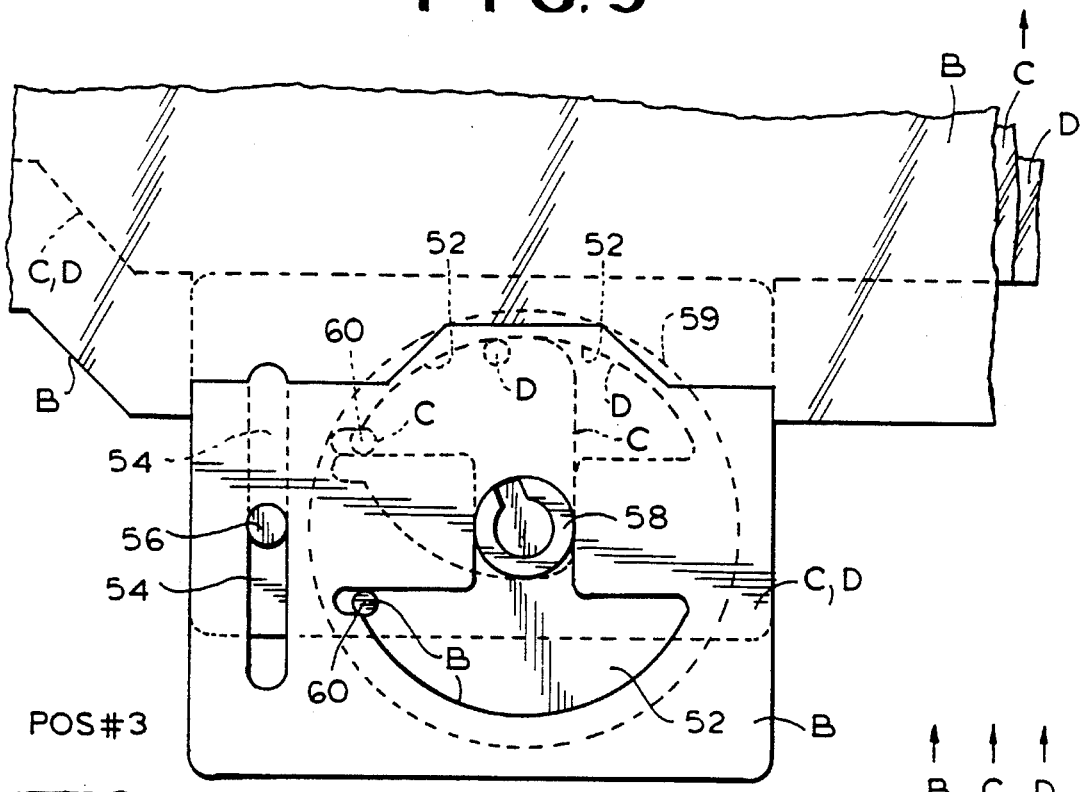
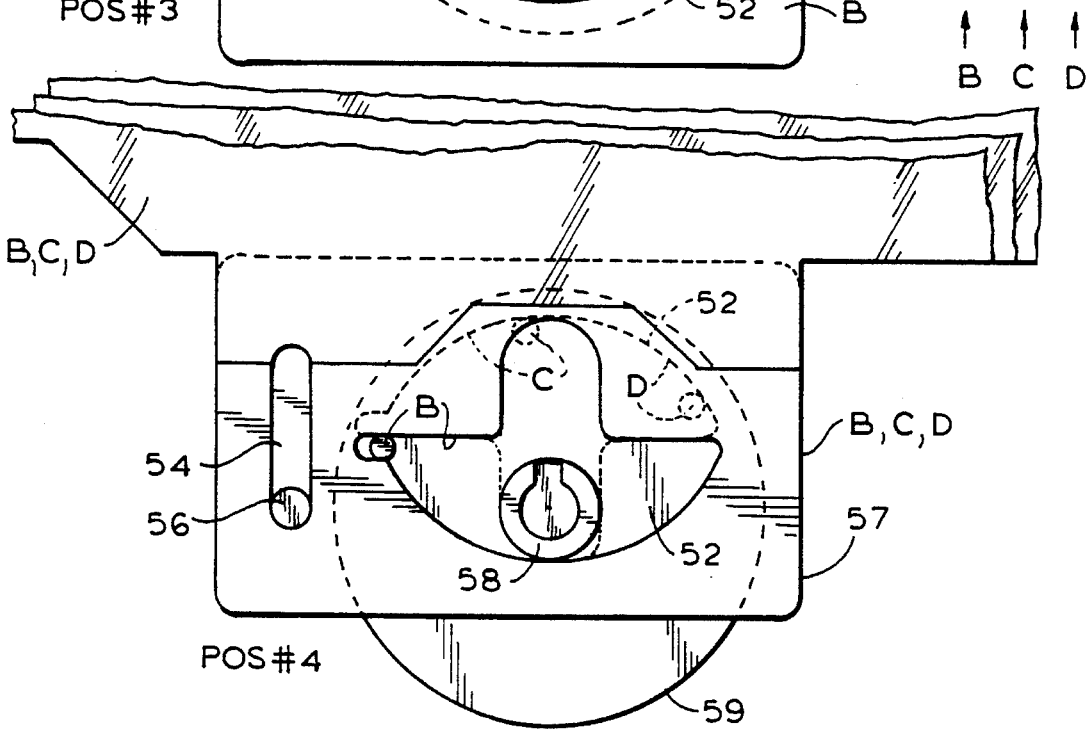
FIG. 10

FIG.11A
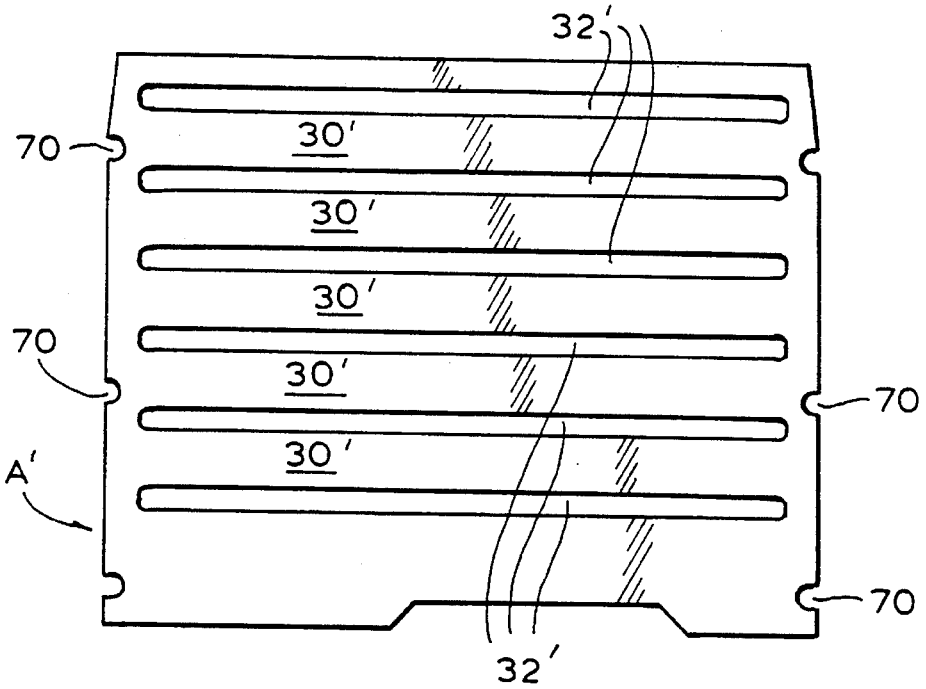
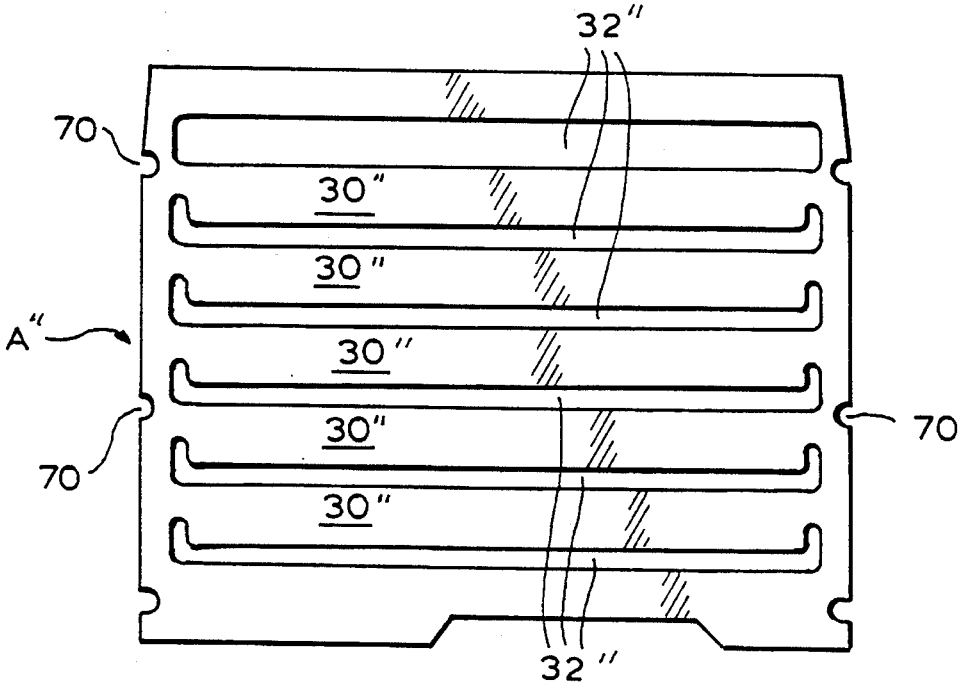
FIG.11B

FIG. 12A
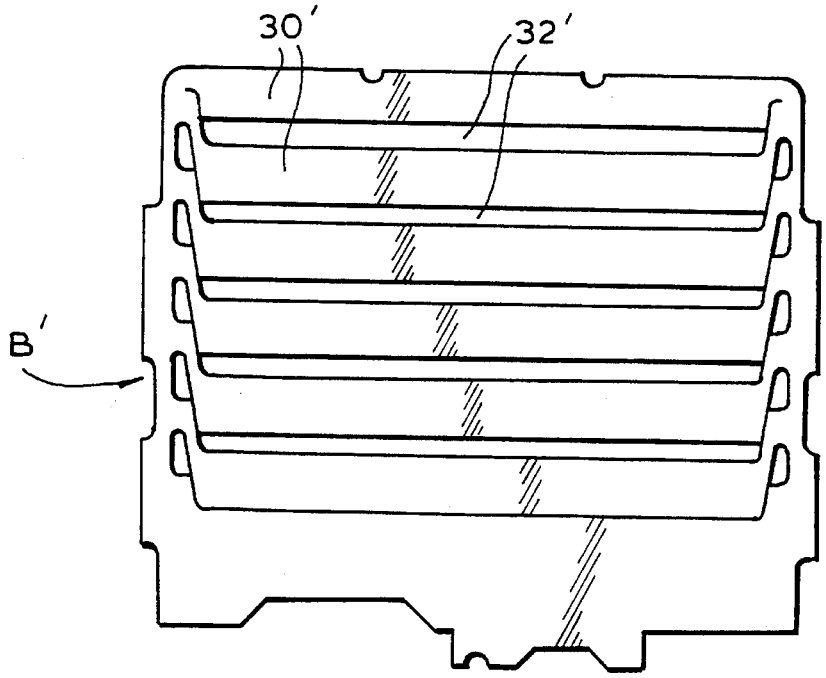
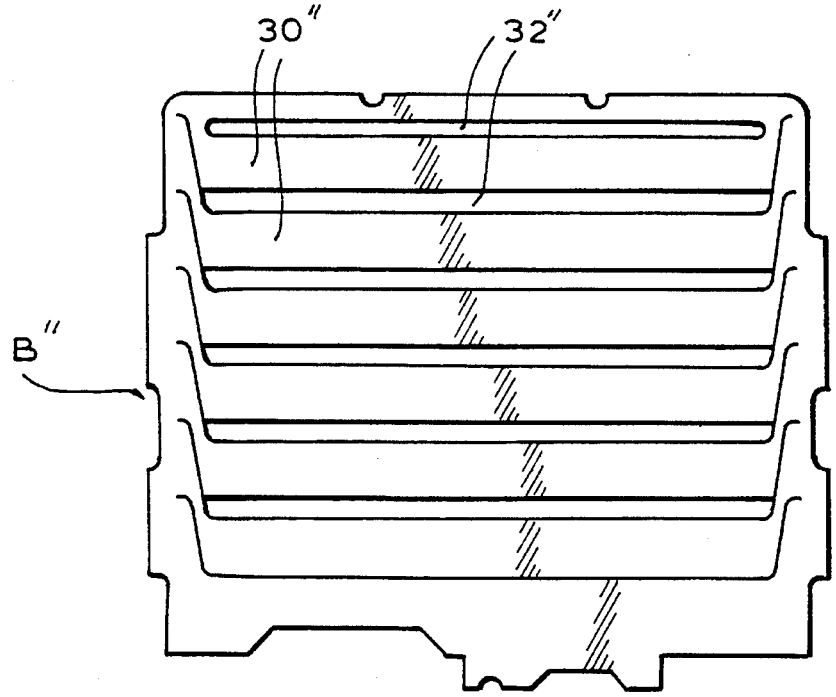
FIG. 12B

FIG. 13A
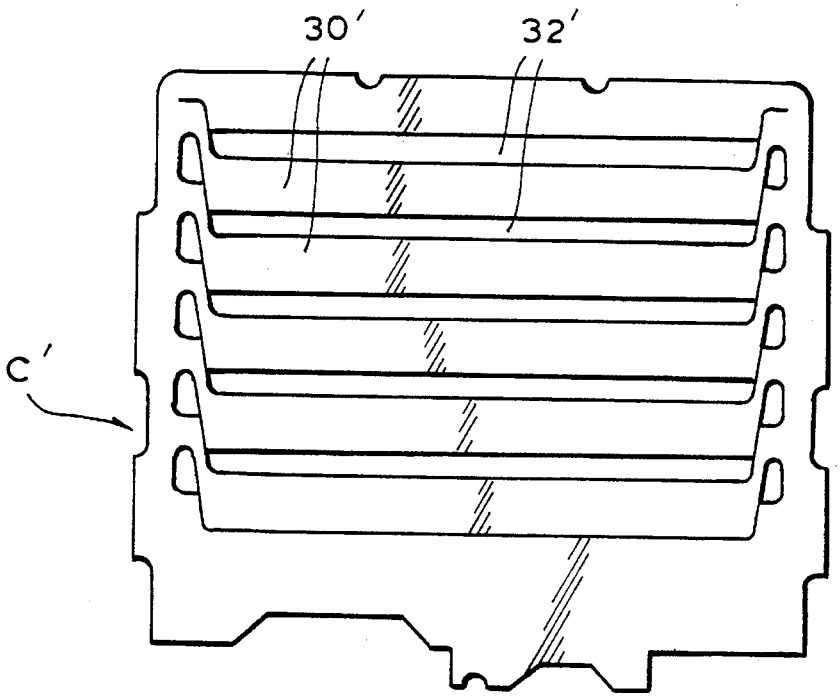
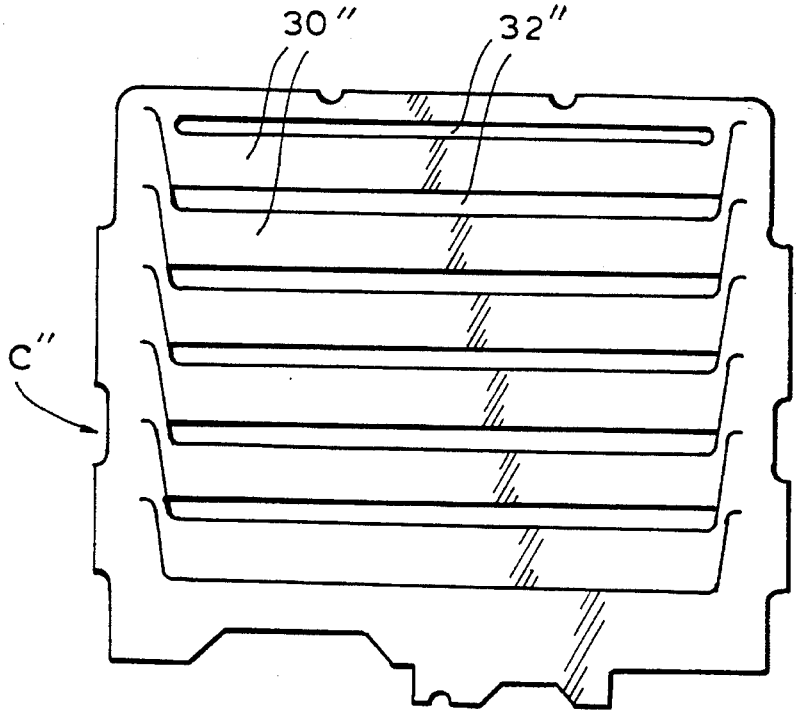
FIG. 13B

FIG. 14A
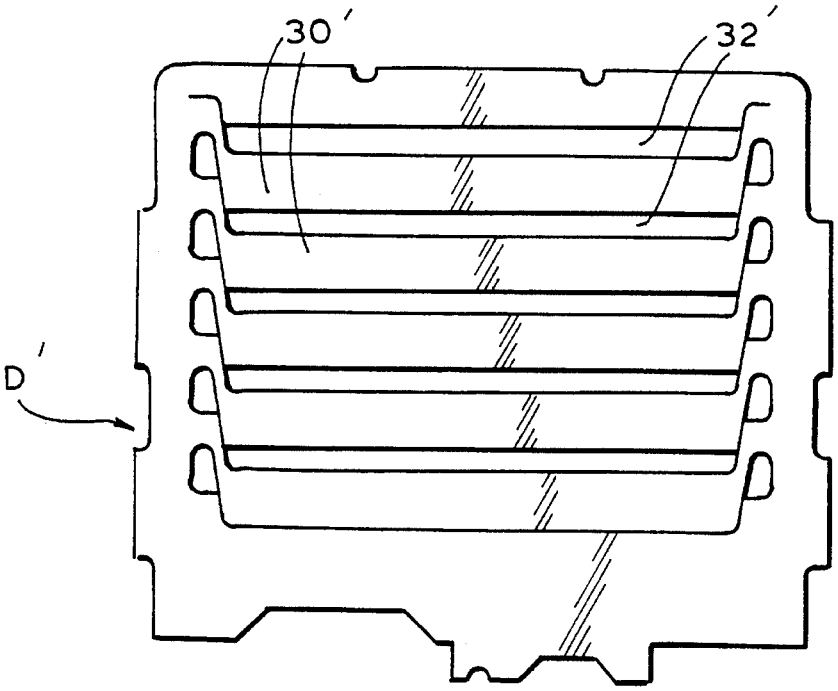
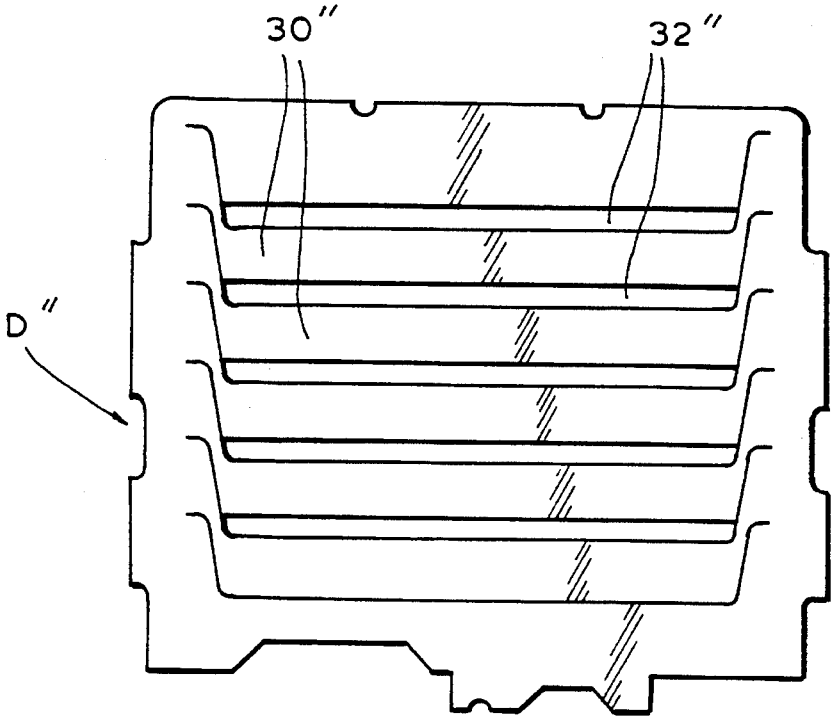
FIG. 14B

FIG.17
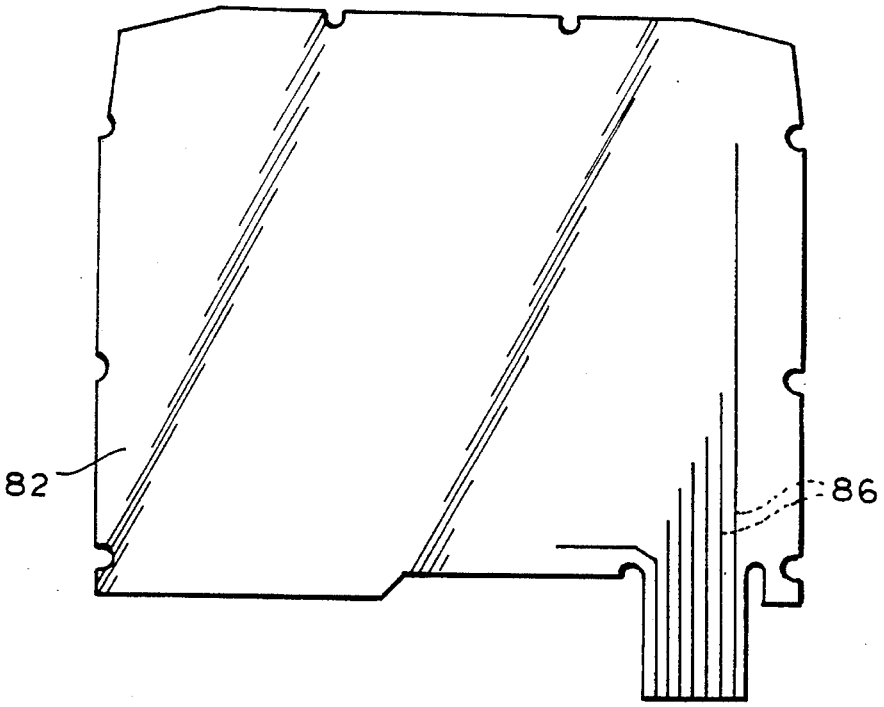
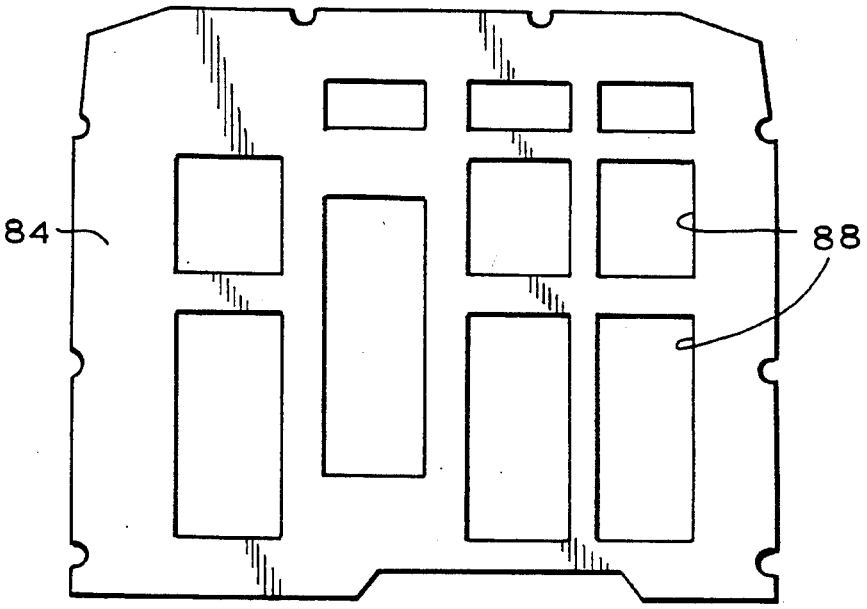
FIG.18

SUCCESSIVE IMAGE DISPLAY DEVICE

BACKGROUND OF THE DISCLOSURE

The present invention relates generally to a device for successively displaying a plurality of images, a panel control system for determining the relative positions of each of a plurality of panels in such a device, and such a device including sound generating apparatus.

It is known to provide a device for displaying alternatively two images where one image is disposed on a fixed sheet and the other image is disposed on a sheet movable relative thereto. Each sheet is subdivided into slats, with the slats of the movable rear sheet being interleaved with the slats of the stationary front sheet so that initially, when the rear sheet is in one extreme position, the image formed by the slats of the rear sheet is perceived and then, when the rear sheet is moved to an opposite extreme position, the image formed by the slats of the front sheet is perceived. As will be appreciated, a single device is limited to the presentation in series of only two images (one defined by the front sheet and one defined by the back sheet) so that, if more than two images are to be displayed, one must use apparatus in the nature of a book having a plurality of pages, each page being a device limited to alternatively showing only two images. See, for example, the book *Hidden Animals*, published in 1992 by The Reader's Digest Association, Inc., ISBN 0-89577-462-3.

Accordingly, it is an object of the present invention to provide a device for successively displaying a plurality of at least three images.

Another object is to provide a panel-control system for determining the relative positioning of each of a plurality of panels in such a device where each of the images is formed by a single respective panel.

A further object is to provide such a device which incorporates sound-generating apparatus.

It is a further object of the present invention to provide such a device wherein the sound produced by actuation of a given sound-generating switch will vary with the image being presented on the device.

SUMMARY OF THE INVENTION

It has now been found that the above and related objects of the present invention are obtained in a device comprising an interactive electronic children's product in the form of a sealed, self-contained plastic frame, optionally approximately 12" in height, 9" in width, and ½" in thickness. Inside the frame is a flexible transparent plastic window, optionally approximately 8¼" in height by 6½" in width, revealing an illustration or picture with various graphic elements describing a scene or story.

Below the window is a dial or knob that has approximately 180° of travel with at least three, and preferably four, different discrete positions. As the dial is rotated to each position, the illustration or picture changes to a different image.

Internally in the frame, beneath the changing illustrations of the window, is a matrix of discrete contact switches covering the entire window area. When the surface of the window is depressed at a particular graphic element of the illustration or picture, a corresponding underlying sound-generating switch is triggered, resulting in an appropriate sound (e.g., a sound effect and/or phrase of synthesized speech).

As the dial is rotated to each position, revealing a different illustration or picture, it specifically registers the new position with an electrical contact to the electronic circuit. The electronic circuit then draws from a bank of sound effects and/or phrases of synthesized speech that are specific and appropriate to the new illustration or picture.

There are three main technical elements to the system:

(1) A plurality of at least three independent panels containing the graphic illustration or pictures.

(2) The dial mechanism controlling the relative position and movement of the graphic panels.

(3) The optional electrical switching system providing the input to the electronic circuit.

(1) Graphic Panels

Each of the four independent graphic panels is composed of a permanent assembly of two die-cut sheets of a tough but flexible plastic or paper material approximately 0.005" in thickness.

Both sheets for each individual panel are initially printed with the identical graphic illustration or picture. The sheets are then die cut to create a longitudinal series of open parallel windows of equal longitudinal length, the windows being separated by parallel bars. The two sheets are then assembled by inserting each of the bars of the bottom sheet in succession from the rear into a respective window of the top sheet. The bars of the bottom sheet are extended through the windows of the top sheet (thereby dividing each window into a pair of louvers) until the graphic image is registered and the resulting parallel bars are overlapping, alternating and of equal longitudinal length. The sheets are then permanently sealed together around the outside perimeter of the louvered area only, leaving open all cut edges of the actual louvers, to form the individual panel.

The independent sealed panels are then assembled by inserting each of the bars or slats of the bottom panel in succession into the rear opening of the louvers of the top panel. At the point of full insertion, the combination of slats of the bottom panel have completely overlapped the slats of the top panel, thus exposing only the fully registered graphics on the slats of the bottom panel.

Conversely, by withdrawing the bottom panel only to the point where the combination of slats of the bottom panel are concealed by the combination of slats of the top panel, only the fully registered graphics of the top panel are exposed. Since the independent panels are configured to be overlapping, this complete transition can be accomplished without complete disassembly; i.e., the actual amount of relative travel of the panels to achieve complete transition is defined only by the exposed longitudinal length of a single louver of an assembled panel.

For successive stages, a fully inserted bottom-to-top panel assembly can be effectively considered a single top panel, with additional bottom panels introduced as desired.

Each individual assembled panel is basically identical in configuration, with the exception that the overall lateral slat length is slightly reduced in each successive panel (from top panel to bottom panel) to allow clearance for the slats of each panel to slide freely in and out of the louvers of the top panel.

(2) Dial Mechanism

The parameters of the dial mechanism are defined in this specific four-transition application by the required relative travel of four independent assembled graphic panels. To achieve four specific transitions, a stationary top louvered graphic panel is complemented with three successive sliding or movable bottom louvered graphic panels. (For five specific transitions, a stationary top louvered panel would be complemented with four successive sliding bottom louvered graphic panels, etc.)

Relative to the stationary graphic panel, the travel of each successive sliding panel is limited to longitudinal motion perpendicular to the slats, and has in sequence an "out" (concealed) or an "in" (exposed) position, with the actual amount of longitudinal travel determined by the exposed longitudinal length of a single louver.

In the present four-transition application, the top panel A is fixed and requires no movement. The first movable panel B is inserted fully to the "in" position, with its slats overlapping slats of the top panel and fully exposing the B graphics. The second movable panel C is then inserted fully to the "in" position, with its slats overlapping all slats of both the B and A panels and fully exposing the C graphics. The final and bottom movable panel D is then fully inserted, with its slats overlapping all slats of the C, B and A panels and fully exposing the D graphics. In this condition, the system is locked, and the sequence is reversed, i.e., the D panel is withdrawn to the "out" position, exposing the C panel; the C panel is withdrawn, exposing the B panel; and the B panel is finally withdrawn exposing the top fixed A panel.

The three movable panels extend inside the frame to the dial or knob position. At the dial position a reinforcing rigid plastic control plate is permanently attached to each of the movable panels. Each control plate has a specifically configured cam slot design and is captured by the dial. Three isolated independent cam disks or layers rotate with the dial, one below the control plate of each movable panel, each cam disk having a strategically located cam pin which maintains complete control of the position and travel of its respective plate (and hence its respective panel) through the entire 180° of dial rotation.

The 180° dial rotation is divided into three 60° segments. In the extreme of clockwise rotation, all three moving panels are held in the "out" (concealed) position and only the fixed A panel is in its permanent "in" (exposed) position. Through the first segment of counterclockwise rotation, the B panel is carried to the "in" position, while the C and D panels are held in the "out" position. Through the second segment of counterclockwise rotation, the C panel is carried to the "in" position, while the B panel is held in the "in" position and the D panel is held in the "out" position. Through the third and final segment of counterclockwise rotation, the D panel is finally carried to its "in" position. In this extreme of counterclockwise rotation, all three moving panels are held in their "in" positions, although only the D panel is visible through the window. From this point, clockwise rotation of the dial reverses the sequence.

(3) Switching System

Input to the electronic circuit and processor consists of a panel of contact switches (e.g., 9 contact switches) directly below and filling the exposed window area, and a sweeping contact switch captured by the dial with four discrete positions (for a four transition application).

The panel contact switches consist of a printed circuit where there is a multiplicity of alternating contact lines defining a plurality (e.g., nine) of discrete switching areas covering the entire window area. A die-cut separator/insulator sheet (approximately 0.040" thick) is mounted directly on the printed circuit. A flexible sheet with a conductive surface on the bottom is then mounted over the separator covering the entire switching area. The separator frames each switching area of the entire panel while exposing as much of the switching area as possible. The function of the separator is to isolate each individual switching area and to provide a positive separation between the printed circuit and the conductive sheet, so that a positive depression must be applied from outside the window area, through the graphic panels, in order to close the contacts of any switching area.

The dial sweeping contact switch consists of a conductive metal stamping (with two extended "fingers") that is captured by and rotates with the dial. One extension or finger of the stamping maintains contact through its entire rotation with a common printed contact line or bus. The other extension or finger of the stamping engages printed contact points in sequence, corresponding to the critical "in" (exposed) positions of the graphic panels.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 1 is a top plan view of a display device according to the present invention;

FIG. 2 is an end elevation thereof;

FIGS. 7, 8, 9 and 10 are fragmentary schematic top plan views, to an enlarged scale, of the control mechanism and panels in the initial position (with all panels down), with panel D elevated, with only panels D and C elevated, and with only panels D, C and B elevated, respectively;

FIGS. 11A and 11B, 12A and 12B, 13A and 13B, and 14A and 14B are top plan views of the top and bottom sheets, respectively, of the respective panels A, B, C, and D;

FIG. 17 is a top plan view of the sheet with conductive ink printed on the undersurface;

FIG. 18 is a top plan view of the separator sheet;

DETAILED DESCRIPTION OF THE PREFERRED EMBODIMENTS

Figure 3:
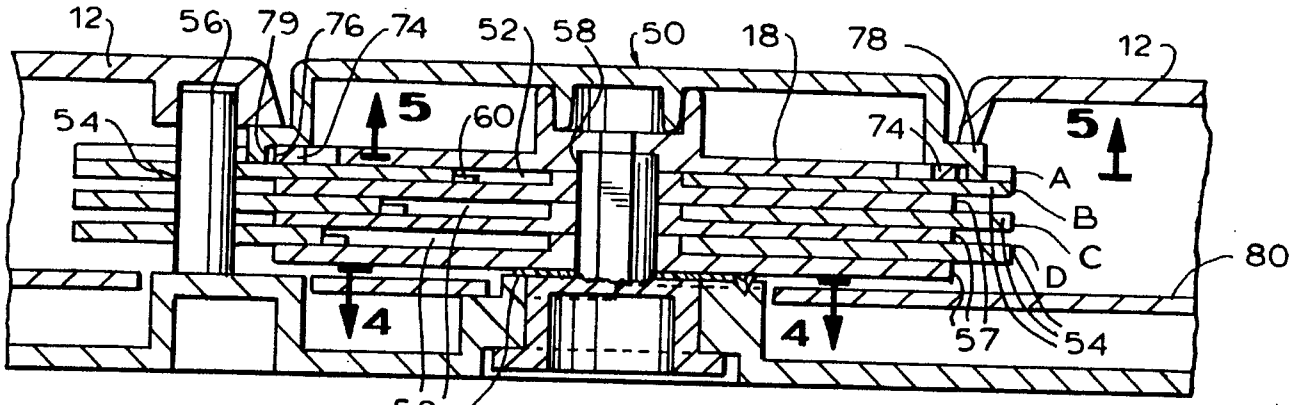
FIG. 3 is a fragmentary sectional view thereof, taken along the line 3—3 of FIG. 1.

Referring now to the drawing, and in particular to FIG. 1 thereof, therein illustrated is a device according to the present invention, generally designated by the reference numeral 10, for successively displaying a plurality of images. In its basic form, the device comprises a two-part plastic case 12 of generally rectangular configuration, the case 12 optionally defining a slot 14 to facilitate grasping of the case 12 for transport purposes. The case 12 defines a large central area 16 through which images may be viewed. A dial or knob 18 is disposed in case 12, the dial being rotatable in order to successively display a plurality of images in the space 16, according to the mechanism to be described hereinafter. In an electronic sound-generating embodiment of the present invention, the case additionally includes a battery compartment 20 adapted to releasably receive a battery therein for powering the electronic circuitry, and at least one speaker grille 22 positioned over a speaker 24 to allow the sound generated by the speaker 24 to be heard.

Each of the interleaved, overlapping panels A, B, C and D, is a composite of two overlying sheets bearing the same image and marginally sealed together. Thus, as illustrated in FIGS. 11A and B, 12A and B, 13A and B, and 14A and B, the panels A, B, C, D are in turn a composite of a top sheet A' and a bottom sheet A", a top sheet B' and a bottom sheet B", a top sheet C' and a bottom sheet C", and a top sheet D' and a bottom sheet D", respectively. Each of the sheets defines a longitudinal series of flexible bars 30 and windows 32 disposed between the bars 30. The bars 30 are longitudinally longer than the windows 32.

For illustrative purposes, each top sheet is illustrated as having a series of bars 30' and windows 32', while each bottom sheet is shown as having a series of bars 30" and windows 32". While each of the sheets forming a given panel contains more or less the same image, due to the presence of the windows the most that can be said is that each sheet defines a partial image and that the two sheets of a panel cooperatively define at least a full image. Thus, the bars of each sheet A', A", B', B", etc. define a partial image, while the bars 30', 30" of both sheets of a panel A, B, etc. define at least a full image. For each panel, the bars 30" of a bottom sheet are laterally narrower than the windows 32' (and hence the bars 30') of a top sheet, thereby to enable bar interleaving as discussed below.

Figure 16A:
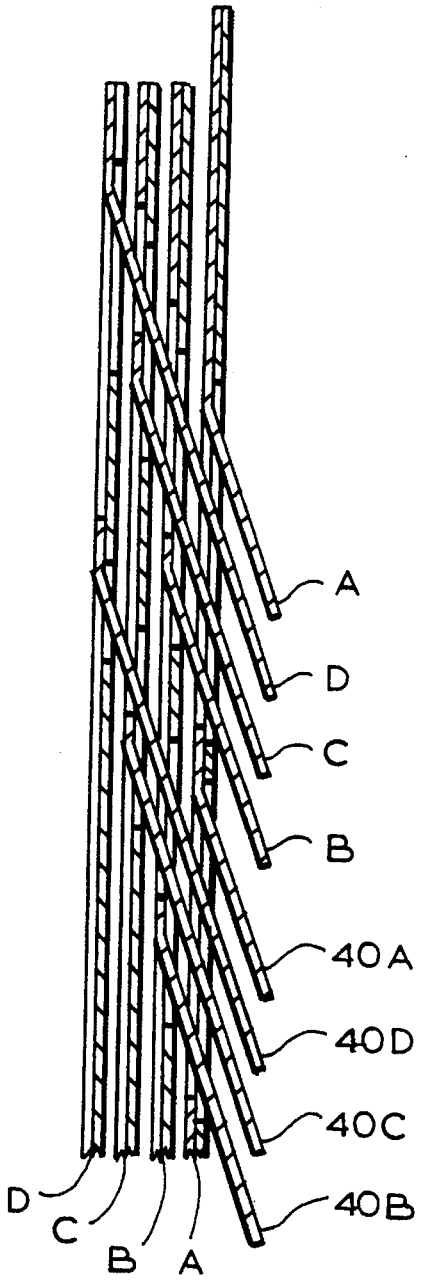
FIG. 16A is a schematic sectional view illustrating how panels are interleaved, taken along the line 16A—16A of FIG. 15.
Figure 16B:
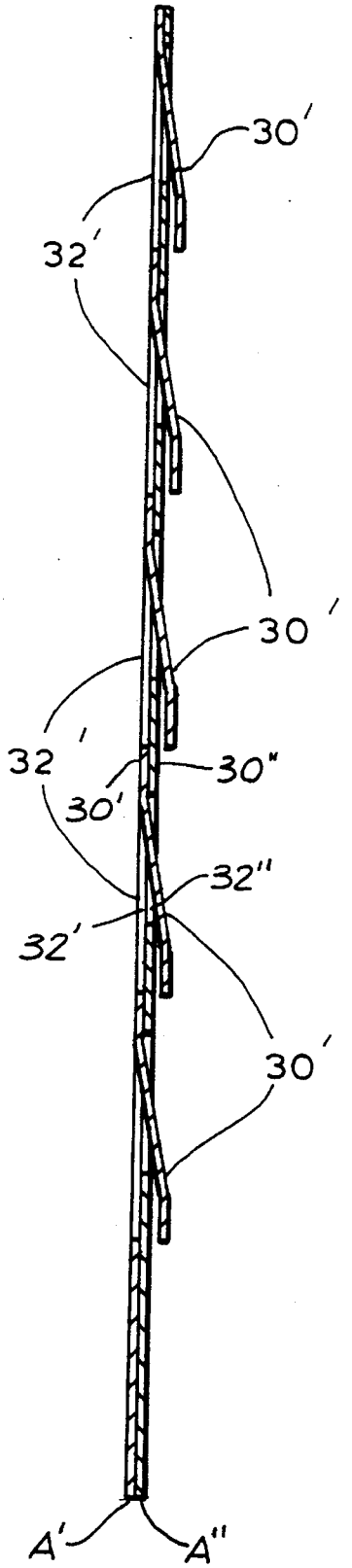
FIG. 16B is a fragmentary schematic sectional view illustrating how two sheets are interleaved to form a panel.

Referring now to FIG. 16B, the top sheet and bottom sheet of each panel (for example, the top sheet A' and bottom sheet A" of panel A) are placed in overlying disposition and the bars 30" of the bottom sheet pushed forward through the window 32' of the top sheet so that the bottom sheet bar 30" partially overlies the top sheet bar 30'. Thus the bars 30' 30" of the two sheets are interleaved. The bars 30', 30" define the slats 40 of a panel. The bottom sheet bars 30" divide each top sheet window 32' into a pair of louvers 42 of the given panel. It will be appreciated that the top and bottom sheets are sealed together only about the perimeter or margin thereof and not at the windows or bars thereof. The sheets are preferably formed of a thermoplastic material enabling the two sheets of the panel to be easily and economically sealed together, for example, by heat-sealing, although other means for securing the sheets together marginally may be employed.

Referring now to FIG. 16A, the panels A, B, C and D are formed according to the construction technique illustrated in FIG. 16B for interleaving two sheets to form a panel. For expository purposes, the interleaved slats 40 are illustrated in FIG. 16A as projecting forwardly at a greater angle than is actually the case. To facilitate reference thereto, the slats 40 of a particular panel are identified by 40X where X is the letter of the panel. Thus, for example, the slats 40 of panel A are referred to as slats 40A.

The fixed panel A is the top panel and immediately thereunder is the movable panel B, the slats 40B being inserted through the louvers 42 of panel A so that they overlap and overlie slats 40A. The slats 40C of the next underlying movable panel C are inserted and pass through the louvers 42 of panels A and B so as to overlap and overlie slats 40B and 40A. Finally, the slats 40D of bottommost panel D are inserted and pass through the louvers 42 of panels C, B and A so as to overlap and overlie the slats 40C, 40B and 40A.

It will be appreciated that while the present invention is illustrated in the drawing as having a plurality of four overlying panels, three of these panels being movable, in fact there may be any plurality N of overlying panels where N is at least three. As a practical matter, N is preferably not greater than 8, as the device then must be thicker, there is additional friction between the panels as the relative positioning thereof is varied, etc.

Referring now to FIGS. 3, 6 and 7–10, therein illustrated is the control mechanism 50 (see FIG. 3) for causing longitudinal movement of one of the movable panels B, C, D relative to the others, while at the same time fixing the other movable panels against longitudinal movement. In particular, FIG. 7 illustrates the movable panels in Pos. 1, wherein all panels are in a down position (only the movable panels B, C and D being illustrated); FIG. 8 illustrates the panels in Pos. 2, wherein panel D is in a longitudinally elevated position relative to panels B and C; FIG. 9 illustrates the panels in Pos. 3, wherein panels D and C are in a longitudinally elevated position relative to panel B; and FIG. 10 illustrates the panels in Pos. 3, wherein panels D, C and B are in a longitudinally elevated position relative to panel A. The relative positions of the overlapping slats 40 of panels A, B, C, D in each of the Positions 1 through 4, are best seen in FIG. 22. The details of the control mechanism 50 are best seen in FIG. 21, wherein the relative positions of the movable panels B, C and D and the elements effecting the same are separately illustrated for each panel in each of the four positions corresponding to Pos. 1–4 of FIGS. 7–10 and 22.

Figure 6:
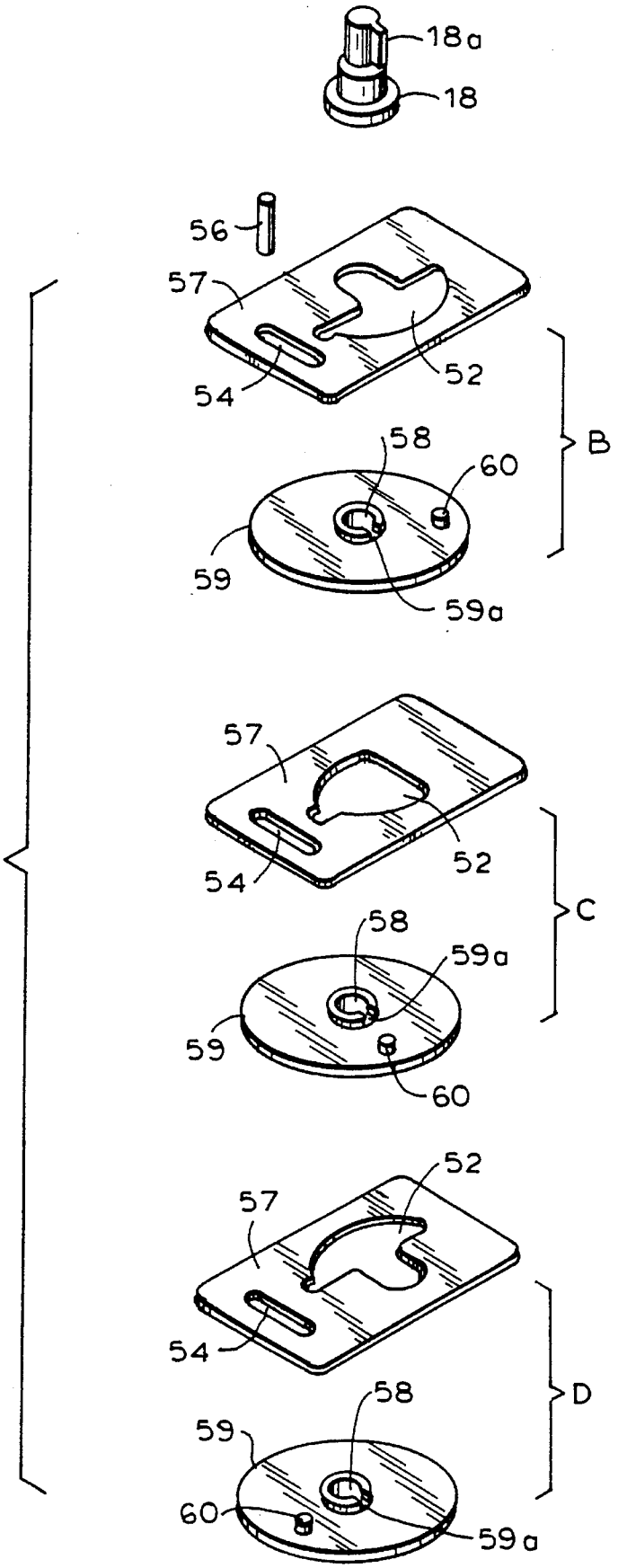
FIG. 6 is an exploded isometric view of the control mechanism of the present invention for moving and fixing the various movable panels of the device.
Figure 15:
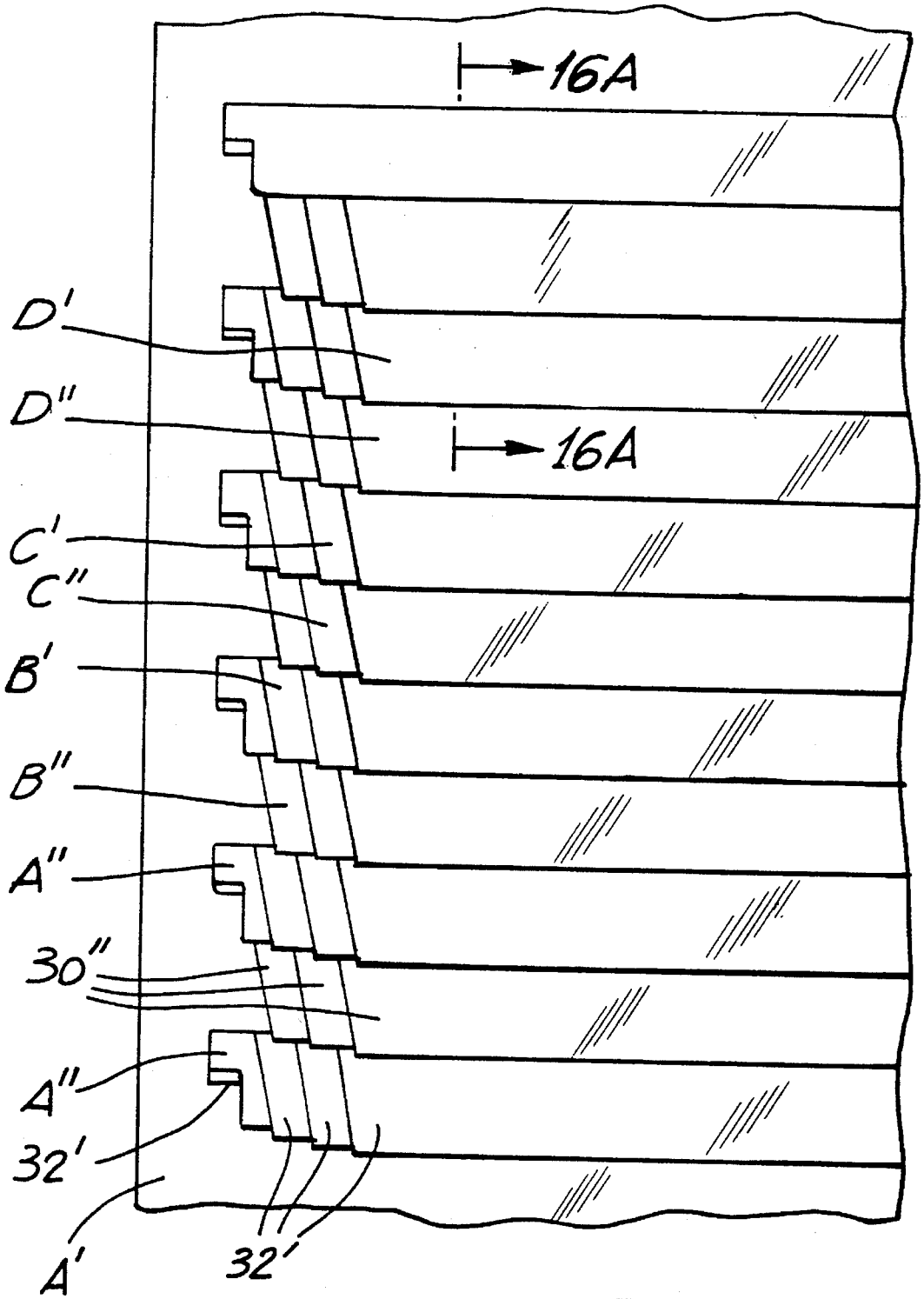
FIG. 15 is a fragmentary top plan view of the interleaved panels A, B, C and D.

As earlier noted, the plastic case 12 is provided with a dial or knob 18 which may be rotated in order to successively display in the viewing space 16 a plurality of images. Each movable panel B, C, D is provided with a re-enforcing rigid plastic control plate 57 which is permanently secured to its respective panel for movement therewith and may be considered to be a part of the panel. As best seen in FIG. 6, in the control plate portion of each movable panel B, C, D, disposed longitudinally below the image-carrying portion of the panel, each panel (actually each control plate 57) defines a cam slot 52 of irregular design and a longitudinally oriented stabilization slot 54. A vertical stabilizing pin 56 fixed to the case 12 extends through the several panel stabilization slots 54 and acts to stabilize each of the movable panels B, C and D (actually the control plates 57 thereof) against lateral or transverse motion, while still enabling limited longitudinal movement thereof as the stabilizing pin 56 travels from one longitudinal end of slot 54 to the other longitudinal end thereof. Preferably each slot 54 is of a substantial longitudinal length, but of a transverse width which fits snugly against stabilizing pin 56.

As best seen in FIGS. 3 and 6, each of the movable panels B, C and D has disposed immediately thereunder a cam disk 59. Each cam disk 59 defines a central aperture 58 and an upstanding cam pin 60, the cam pin 60 being disposed in the cam slot 52 of the immediately overlying movable panel. Each cam disk 59 is secured to the shaft of knob 18 for rotation therewith. For example, each cam disk 59 may have a keyway 59*a* extending off of aperture 58, and the knob 18 may have a projecting key 18*a* on its shaft, the key 18*a* being disposed in the keyway 59*a* to secure the knob 18 and cam disk 59 for rotation as a unit. FIG. 21 illustrates various relative positions of the cam key 18*a* and cam pin 60 in each of the various Positions 1–4.

Figure 21:
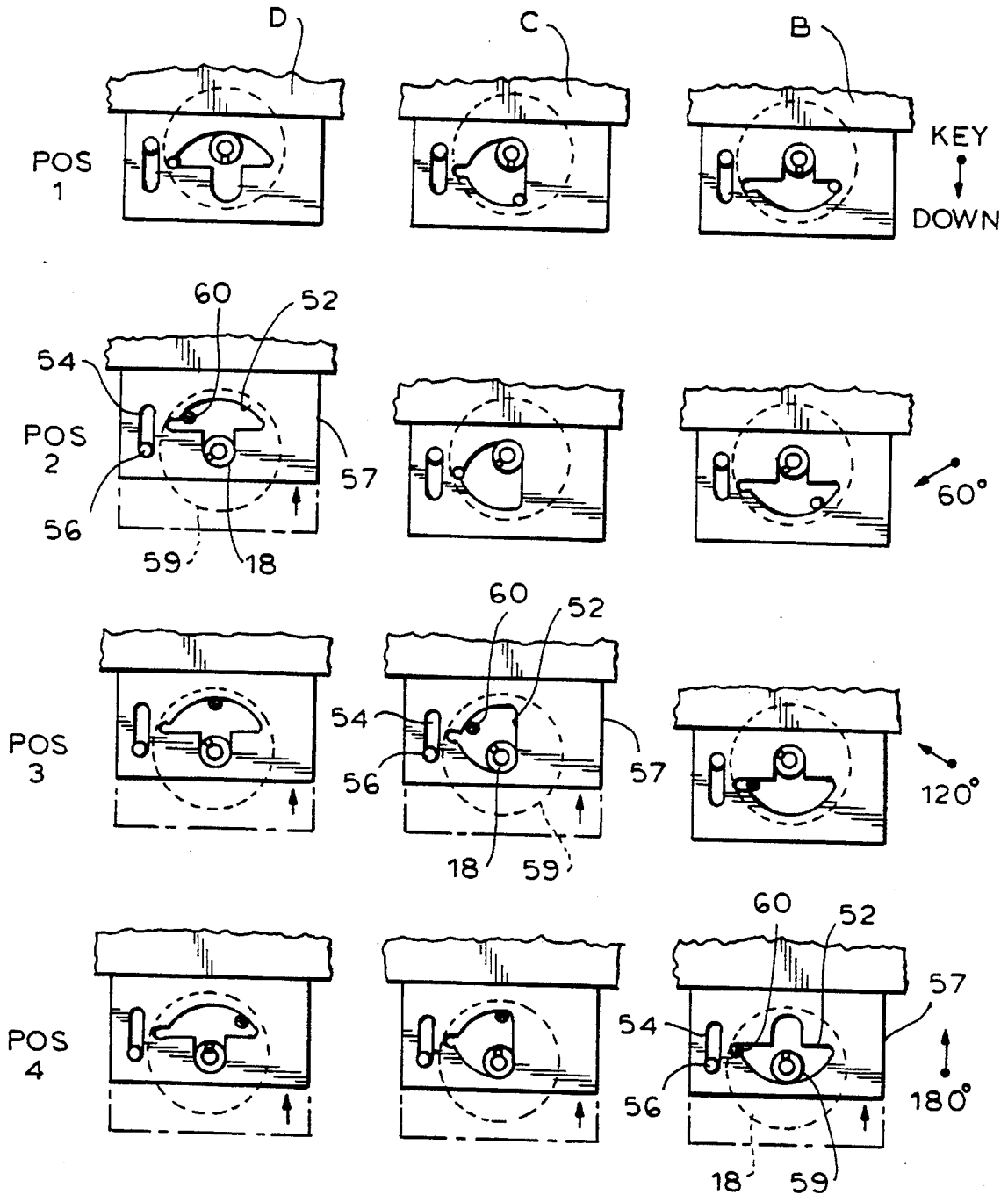
FIG. 21 is a schematic representation of the control system showing separately the position of each of the panels as the key of the knob is rotated among four different positions (Pos. 1–4)
Figure 22:
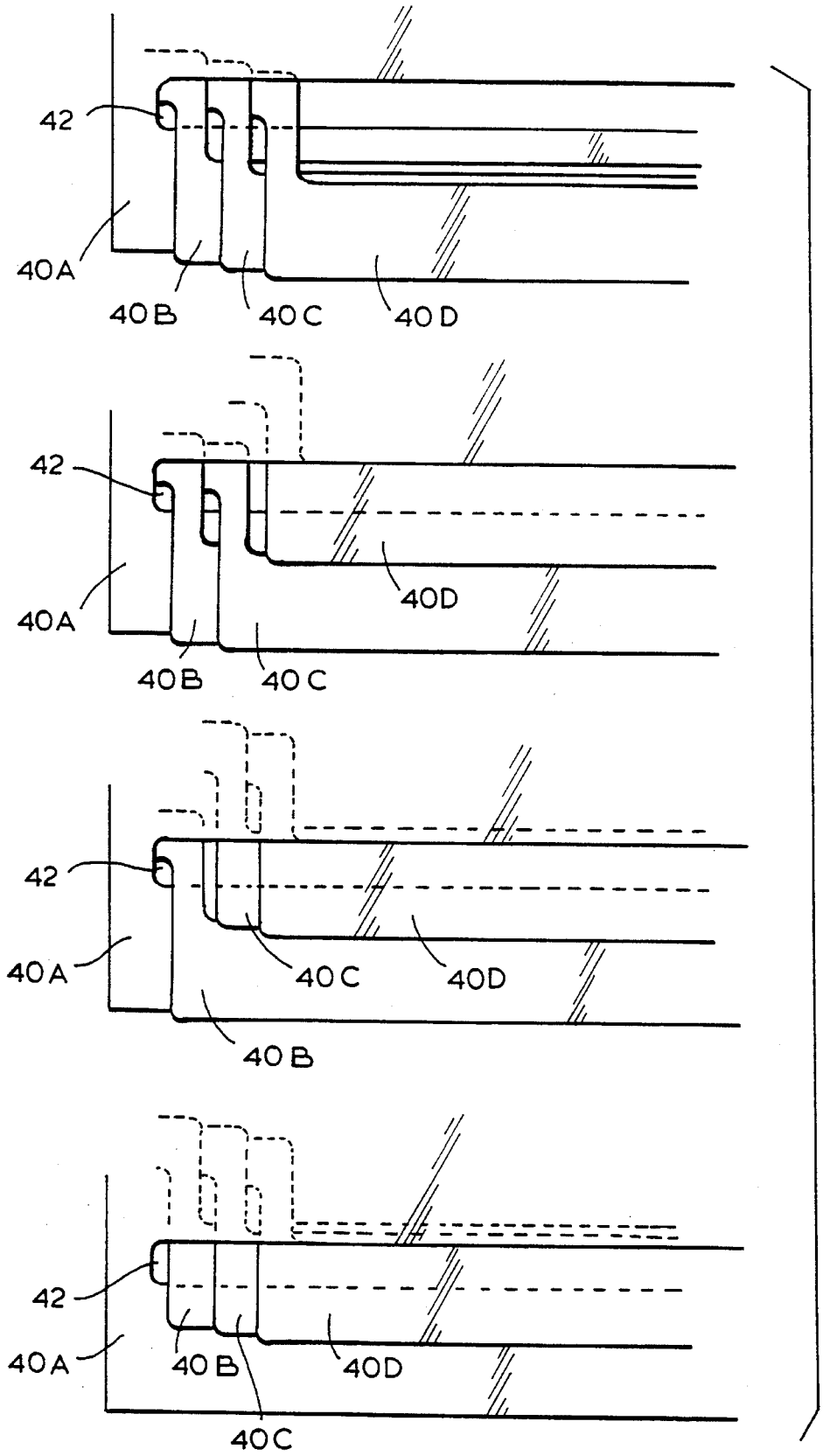
FIG. 22 is a fragmentary front plan view of the interleaved panels in the four different positions (Pos. 1–4)
Figure 23:
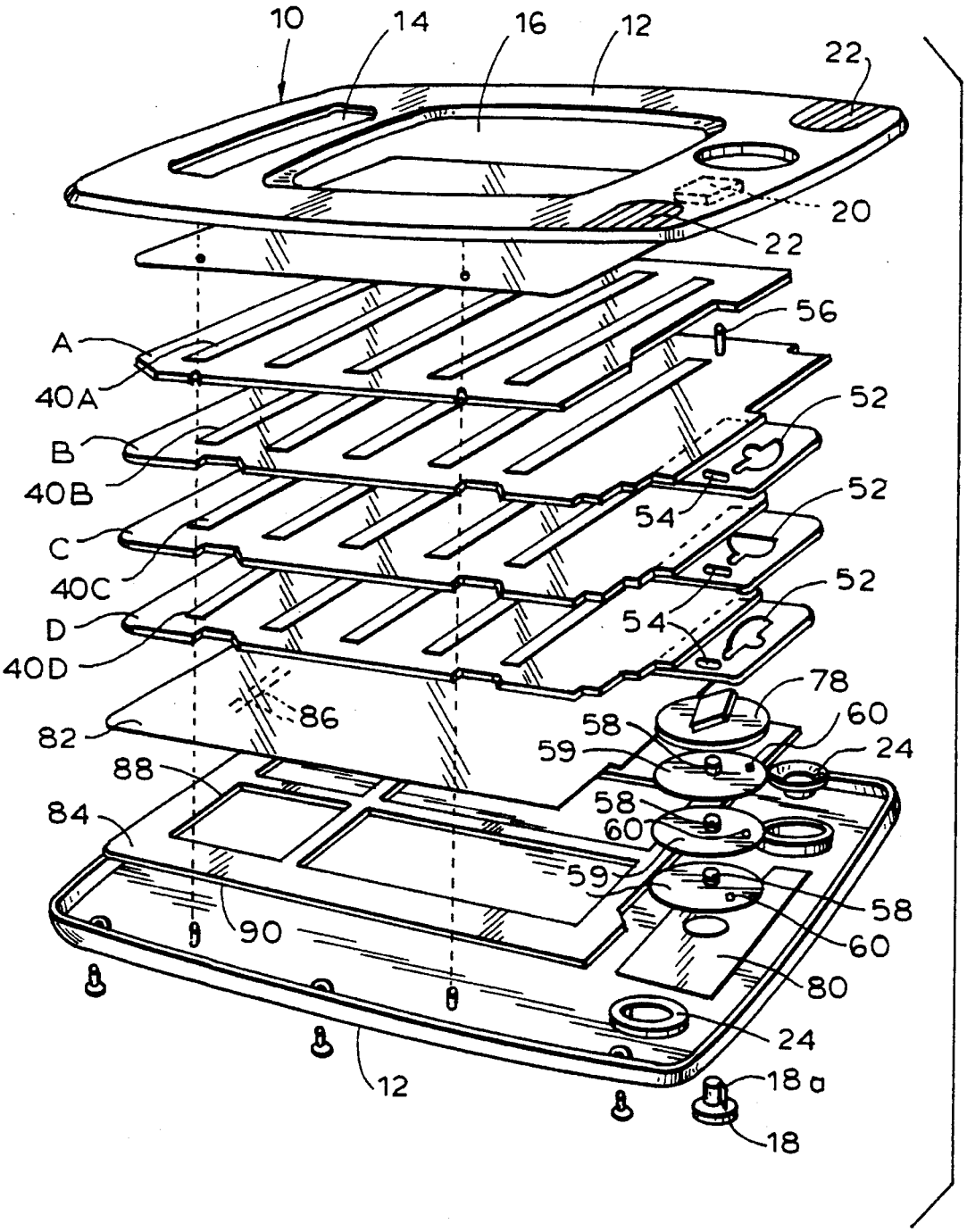
FIG. 23 is an exploded isometric view of an embodiment of the device with a single speaker.

Referring now to FIG. 21, it will be appreciated that in initial Position 1 the cam pins 60 are so disposed in the cam slots 52 as to preclude any longitudinally upward motion of the movable panels B, C, D. Furthermore, the stabilizing pin 56 is at the longitudinal top of the stabilization slot 54 of each panel, and the knob shaft is at the longitudinal top of the cam slot 52 of each panel.

When the knob 18 is rotated clockwise through a predetermined angle (here illustrated as 60°) from "key down" to "key 60°" to Pos. 2, the cam pin 60 of the cam disk 59 associated with panel D moves to a new position along the curvature of the cam slot 52 and thereby forces the cam slot 52 (and hence the panel D) longitudinally upwardly, as evidenced by the stabilizing pin 56 now being at the longitudinal bottom of stabilization slot 54 and the knob shaft 18 now being at the longitudinal bottom of the cam slot 52. The movement of the cam disk 59 further frees the cam pin 60 for further movement along the curved perimeter of the cam slot 52 (in response to further knob rotation) without further longitudinal movement of panel D. On the other hand, the movement of the cam disks 59 associated with panels B and C still leaves their cam pins 60 in positions precluding upward movement of the panels B and C with panel D despite any frictional engagement therebetween.

Next, when the knob 18 is rotated clockwise through a further 60° from "key 60°" to "key 120°"to Pos. 3, the cam pin 60 of the cam disk 59 associated with panel C moves to a new position along the curvature of the cam slot 52 and thereby forces the cam slot 52 (and hence the panel C) longitudinally upwardly, as evidenced by the stabilizing pin 56 now being at the longitudinal bottom of stabilization slot 54 and the knob shaft 18 now being at the longitudinal bottom of the cam slot 52. The movement of the cam disk 59 further frees the cam pin 60 for further movement along the curved perimeter of the cam slot 52 (in response to further knob rotation) without further longitudinal movement of panel C. On the other hand, the movement of the cam disk 59 associated with panel B still leaves its cam pin 60 in a position precluding upward movement of the panel B with panel C despite any frictional engagement therebetween. Thus, in Pos. 3, panel C has joined panel D in a longitudinally elevated position.

Finally, when the knob 18 is rotated clockwise through a further 60° from "key 120°" to "key 180°" to Pos. 4, the cam pin 60 of the cam disk 59 associated with panel B moves to a new position along the curvature of the cam slot 52 and thereby forces the cam slot 52 (and hence the panel B) longitudinally upwardly, as evidenced by the stabilizing pin 56 now being at the longitudinal bottom of stabilization slot 54 and the knob shaft 18 now being at the longitudinal bottom of the cam slot 52. At this point, panels B, C and D are in the longitudinally elevated position.

As best seen in FIG. 22, in Pos. 1 the image formed by panel D is visible, in Pos. 2 the image formed by panel C is visible, in Pos. 3 the image formed by panel B is visible, and in Pos. 4 the image formed by the fixed panel A becomes visible in the space 16.

The case 12 is provided with lugs which engage marginal slots 70 (see FIGS. 11A and 11B) of the panel A to preclude both longitudinal and transverse movement thereof relative to the case 12.

Preferably the assembly of interleaved panels A, B, C and D disposed behind the imaging space 16 of the case 12 is covered with a clear plastic sheet 100 to protect the interleaved panels from being played with by a user who might accidentally destroy the interleaf structure.

Figure 5:
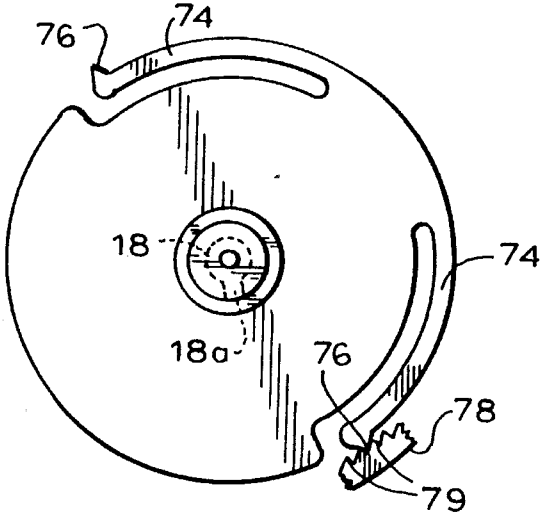
FIGS. 4 and 5 are fragmentary sectional views thereof, to an enlarged scale, taken along the lines 4—4 and 5—5, respectively, of FIG. 3.

In the preferred embodiment of the present invention illustrated in FIGS. 3 and 5, the knob 18 for changing the relative positions of the panels is not directly accessible by the user. Rather, the knob 18 is formed of a resilient material and provided with a pair of outwardly biased arms 74 which have lugs 76 normally extending outwardly beyond the unstressed diameter of the knob 18. The knob 18 (including cam 74) is covered by a knob cover 78 having an inner surface defining a ratchet-like plurality of indentations 79 on the inner circumference thereof, the indentations 79 being adapted to engage the lugs 76 for securing together the knob cover 78 and knob 18 for rotation as a unit. However, when movement of the panels is prevented—for example, because the user is applying downward pressure on the panels, actually holding the slats thereof against movement or the like—the resistance of the panels to movement will prevent the knob 18 from rotating with the knob cover 78, the knob arms 74 simply retreating inwardly to temporarily break the engagement of the lugs 76 and the indentation 79.

Figure 19:
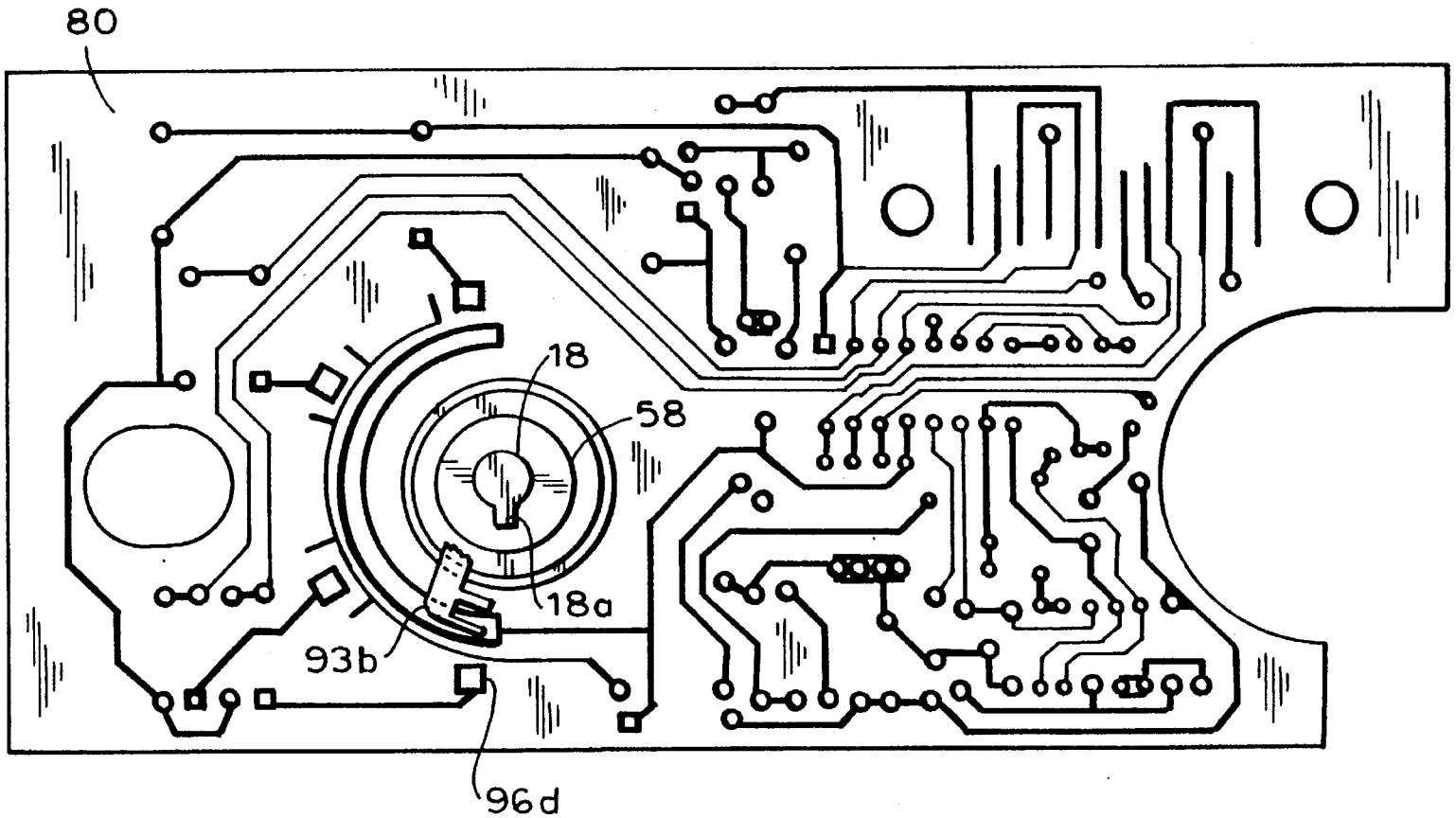
FIG. 19 is a top plan view of the circuit sheet.
Figure 20:
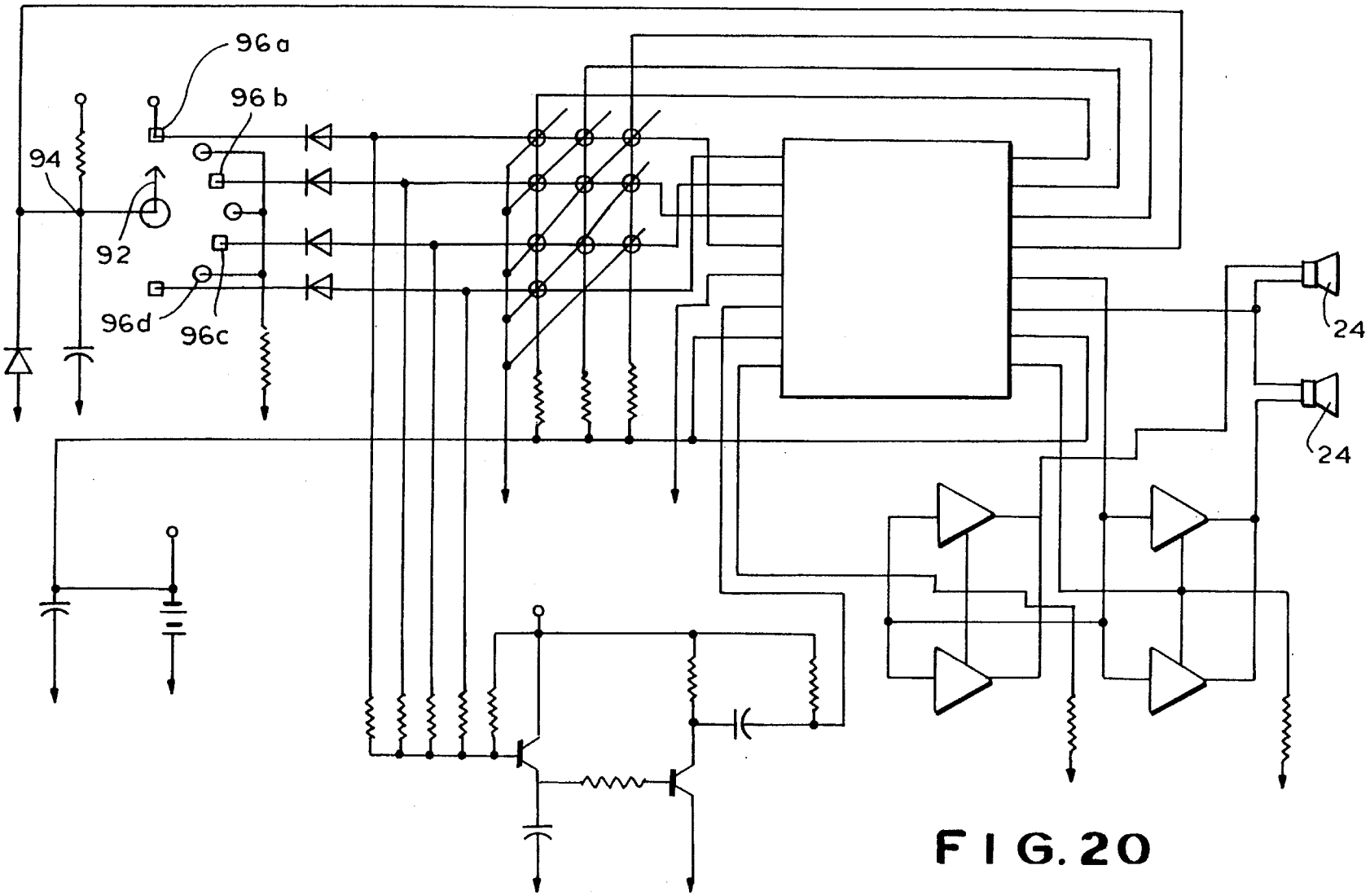
FIG. 20 is a circuit diagram of the electrical components.

As will be readily apparent to those skilled in the sound-generating toy art, the device 10, as described above, readily lends itself to a sound-generating embodiment. Thus an electronic circuit of the type illustrated in FIG. 20 may be realized through use of a printed circuitboard 80 (as illustrated in FIG. 19), a flexible sheet 82 (as illustrated in FIG. 17), and an insulative separator sheet 84 therebetween (as illustrated in FIG. 18). At one or more locations of the undersurface of the flexible sheet 82, there are interrupted printed circuits 86 formed by conductive ink. Underlying the interruptions in the printed circuits 86 are openings 88 of the separator sheet 84 and, thereunder, shorting contacts 90 of the printed circuitboard 80. Thus when the flexible sheet 82 is depressed in the area of an interrupted circuit 86, the interrupted circuit 86 passes through the underlying opening 88 of the separator sheet and is closed or "shorted" by an underlying contact 90 on the printed circuitboard. Alternatively, the shorting contacts 90 may be disposed on the undersurface of the flexible sheet 82, and the interrupted circuits 86 formed on the printed circuitboard 80. In either case, the depression of the flexible sheet 82 in an appropriate area actuates or closes a circuit for generating an appropriate sound, as illustrated in FIG. 20. For example, for a 6"×8" viewing area, nine sound-generating switches may be provided, each switching area underlying a representation of a unique sound-generating object or creature. As the sound-generating apparatus described above is conventional, it is not deemed necessary to describe the same in further detail herein.

It will be appreciated that the sound-generating apparatus described hereinabove will produce the same sound each time the same interrupted circuit 86 is closed by depression of the flexible sheet 82 in the appropriate area. Typically the flexible sheet 82, separator sheet 84 and printed circuitboard 90 are disposed underneath the interleaved panels A, B, C, D within the viewing or imaging space 16 so that the user may simply press on an appropriate location of the viewing area 16 and have the downward pressure exerted by the finger communicated through the interleaved panels to the flexible sheet 82 therebelow. It will be appreciated that the flexible membrane 82, separator 84 and printed circuitboard 80 cooperatively define at least one sound-generating switch, and typically a plurality of sound-generating switches, with each switch responsive to pressure in a certain area of the sheet 100 (which for this reason is resiliently flexible). However, in the apparatus described hereinabove, actuation of a given switch will result in production of the same sound, thus limiting the play value of the device.

Figure 4:
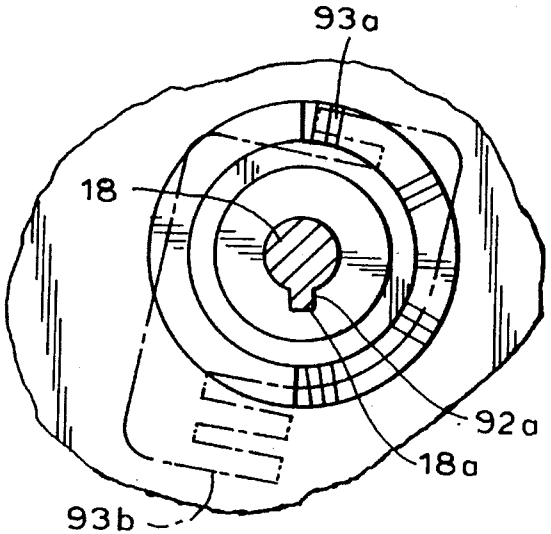

Accordingly, in a preferred embodiment of the present invention, means are provided for varying the sound generated according to the particular panel being shown and hence the particular image being seen in the viewing area 16. Thus, referring now to FIGS. 3 and 4, underneath the control mechanism 50 for varying the position of the panels A, B, C, D there is a conductive member 92 secured to the shaft of knob 18 for rotation therewith. For example, the conductive member 92 may define a keyway 92*a* for receipt of the shaft key 18*a*. Referring now to FIGS. 19 and 20 as well, the conductive member 92 has two extended fingers 93*a*, 93*b* configured and dimensioned to provide conductive communication between a common bus element 94 on the printed circuitboard 80 and one of four different selectors 96*a*, 96*b*, 96*c*, and 96*d*, depending upon which position of Pos. 1–4 the knob 18 is in at a given instant. Thus the sound to be produced by closing of a given sound-generating switch 86, 88, 90 will be determined by the orientation of conductive member 92. Either directly via the sound-generating chip, or indirectly via the microprocessor, a different bank of sounds is accessed depending on which selector 96 is connected to the common base 94 by conductive member 92. However, as both the image seen through viewing area 16 and the sound generated by closure of a given sound-generating switch 86, 88, 90 are both dependent upon the orientation of knob 18, the sound to be generated by closure of a given sound-generating switch is a direct function of the image being viewed. The ability of the device to generate sounds which vary with the image being shown greatly increases the play value of the device.

For example, the device may provide an audio-visual commentary on the four seasons of the year: winter, spring, summer and fall. Each panel may present an image appropriate to a particular season (for example, the winter season image showing a warmly dressed person in snow and the summer season image showing a bathing suit clad person in beach scene). When a given sound-generating switch is closed, typically over the person image, if the winter scene is being displayed, the audio-commentary may be, "See the snow. It is cold." But when the same switch is actuated with the summer scene displayed, the audio-commentary may be, "It's hot. Let's swim." (Of course, other images and commentaries would normally be provided for the remaining panels representing spring and fall.)

While the printed circuitboard has been illustrated in FIG. 19 as having only four alternative sounds (selector 96) to be generated for each sound-generating switch, clearly a separate sound or audio-commentary may be generated for each of the panels in a given device containing a different number of panels.

It is well-known in the sound-generating toy art to enable repeated pressing of a given sound-generating switch to access a logical branching of audio responses, thereby allowing for progressive development of stories and scenarios via a genuine interaction with the user. It will be appreciated, however, that such a logical branching of responses does not ensure that there will be a correlation between an image being displayed and a sound being generated. In the present invention, the image and sound are correlated even though the user may, for example, simply switch back and forth between two images rather than proceeding in sequence through each of the four images.

In order to further stabilize the elements of the device 10 against relative lateral or transverse movement, as illustrated in FIG. 22, pins may extend from the bottom half of the casing 12, through apertures in the separator sheet 84 and the flexible membrane 82, through elongated slots in the margins of the panels D, C, B, and through apertures in the fixed panel A and the cover sheet 100 into the top half of the casing 12. The elongated slots in the lateral margins of the movable panels B, C, D are sufficiently elongate to enable the desired longitudinal movement of these panels.

To summarize, the present invention provides a device for successively displaying a plurality of at least three images. The invention further provides a panel-control system for determining the relative positioning of each of a plurality of panels in such a device where each of the images is formed by a single respective panel. The device may also incorporate a sound-generating apparatus wherein the sound produced by actuation of a given sound-generating switch will vary with the image being presented on the device.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A device for successively displaying a plurality of images, comprising:

(A) a plurality N of overlying flexible panels where N is at least 3, each of said panels defining a longitudinal series of flexible slats and louvers between said slats, said slats being longitudinally longer than said louvers, each of said slats of all underlying panels being interleaved longitudinally through said louvers of all overlying panels, said slats of each panel cooperatively defining one of said plurality of images, each of said slats of an overlying panel being laterally narrower than said slats of all underlying panels; each of said panels being a composite of two overlying flexible sheets marginally sealed together along the longitudinal edges thereof, each of said sheets defining a longitudinal series of flexible slats and windows between said slats, said slats being longitudinally longer than said windows, each of said slats of the underlying sheet being interleaved longitudinally through said windows of the overlying sheet to divide each window of the overlying sheet into two louvers, said slats of each sheet defining a partial one of a plurality of images and the slats of both sheets of a panel defining at least a full one of said plurality of images, each of said slats of the overlying sheet being laterally narrower than said slats of the underlying sheet; and (B) means for moving in turn each of a subset N–1 of said plurality of panels a length greater than the length of a louver such that movement of a given panel in one longitudinal direction exposes the slats of an adjacently overlying panel and conceals the slats of the given panel underneath the slats of an underlying panel, and movement of said given panel in the opposite longitudinal direction exposes the slats of said given panel and conceals the slats of an adjacently overlying panel under the slats of said given panel.

2. A panel control system for determining the relative positions of each of a plurality of panels, comprising:

(A) a knob defining an axis therethrough, said knob being rotatable about said axis between a plurality of N positions;

(B) a plurality N of overlying flexible panels, one of said panels being stationary and each panel of the remaining subset N–1 of said plurality of panels being independently movable along a longitudinal axis relative to the stationary panel and defining a cam slot; and (C) N–1 cam disks, each cam disk being secured to said knob for rotation therewith, being associated with a respective one of said movable panels, and defining a cam pin disposed in the cam slot of a respective movable panel;

each said cam pin being fixedly disposed on a respective one of said cam disks for movement therewith, and each of said cam slots being configured and dimensioned to cooperate with the cam pin disposed therein such that rotation of said knob, and hence said cam disk, causes longitudinal movement of one of said movable panels at a given time while simultaneously restraining the remaining movable panels against longitudinal movement therewith.

3. The system of claim 2 additionally including means fixing said movable panels against relative transverse movement.

4. A sound generating device comprising a housing structure housing:

(A) the system of claim 2;

(B) means for displaying an image formed by one of said panels when said panels are in a predetermined relative orientation, the relative orientation of said panels determining which image will be seen;

(C) means for generating sounds according to the setting of a switch means; and (D) switch means secured to said knob for rotation therewith, the orientation of said switch means determining which sound will be generated by said sound generating means;

whereby rotation of said knob controls and correlates both the image to be displayed and the sounds to be heard.

5. The device of claim 2 wherein said plurality N is at least 3.

6. The device of claim 5 wherein said subset N–1 of said plurality is at least 2.

7. The device of claim 4 wherein said plurality N is at least 3.

8. The device of claim 7 wherein said subset N–1 of said plurality is at least 2.

9. A sound generating device for successively displaying a plurality of images, comprising a housing structure housing:

(A) the device of claim 1 wherein said panels are interleaved;

(B) means for displaying an image formed by one of said panels when said panels are in a predetermined relative orientation, the relative orientation of said panels determining which image will be seen;

(C) means for generating sounds according to the relative orientation of said panels and hence the image which will be seen.

10. A sound generating device for successively displaying a plurality of images, comprising a housing structure housing:

(A) a plurality of overlying interleaved panels flexible;

(B) means for displaying an image formed by one of said panels when said panels are in a predetermined relative orientation, the relative orientation of said panels determining which image will be seen;

(C) means for generating sounds according to the actuation of a switch means; and (D) a plurality of switch means disposed under said panels in a respective plurality of positions, the location of a given switch means under said panels determining which sound will be generated by said sound generating means when said given switch means is activated.

11. A sound generating device for successively displaying a plurality of images, comprising a housing structure housing:

(A) a plurality of overlying and interleaved flexible panels;

(B) means for displaying an image formed by one of said panels when said panel are in a predetermined relative orientation, the relative orientation of said panels determining which image will be seen;

(C) means for generating sounds according to the actuation of a switch means; and (D) a plurality of switch means disposed under said panels in a respective plurality of positions, the location of a given switch means under said panels determining which sound will be generated by said sound generating means when said given switch means is activated;

said device including a plurality N of overlying panels, where N is at least 2, each of said panels defining a longitudinal series of flexible slats and louvers between said slats, said slats being longitudinally longer than said louvers, each of said slats of all underlying panels being interleaved longitudinally through said louvers of all overlying panels, said slats of each panel cooperatively defining one of said plurality of images, each of said slats of an overlying panel being laterally narrower than said slats of all underlying panels; and including means for moving in turn each of a subset N–1 of said plurality of panels a length greater than the length of a louver such that movement of a given panel in one longitudinal direction exposes the slats of an adjacently overlying panel and conceals the slats of the given panel underneath the slats of an underlying panel, and movement of said given panel in the opposite longitudinal direction exposes the slats of said given panel and conceals the slats of an adjacently overlying panel under the slats of said given panel.

12. A device for successively displaying a plurality of images by controlling the relative positions of each of a plurality of panels and for generating sounds appropriate to the image being displayed, comprising a housing structure housing:

(A) a plurality N of overlying flexible panels where N is at least 3, one of said panels being stationary and each panel of the remaining subset N–1 of said plurality of panels being independently movable along a longitudinal axis relative to the stationary panel and defining a cam slot, each of said panels defining a longitudinal series of flexible slats and louvers between said slats, said slats being longitudinally longer than said louvers, each of said slats of all underlying panels being interleaved longitudinally through said louvers of all overlying panels, said slats of each panel cooperatively defining one of a plurality of images, each of said slats of an overlying panel being laterally narrower than said slats of all underlying panels;

each of said panels in turn being a composite of two overlying flexible sheets marginally sealed together, each of said sheets defining a longitudinal series of flexible slats and windows between said slats, said slats being longitudinally longer than said windows, each of said slats of the underlying sheet being interleaved longitudinally through said windows of the overlying sheet to divide each window of the overlying sheet into two louvers, said slats of each sheet defining a partial one of said plurality of images and the slats of both sheets of a panel defining at least a full one of said plurality of images;

(B) means for moving in turn each of said subset N−1 of said plurality of panels a length greater than the length of a louver such that movement of a given panel in one longitudinal direction exposes the slats of an adjacently overlying panel and conceals the slats of the given panel underneath the slats of an underlying panel, and movement of said given panel in the opposite longitudinal direction exposes the slats of said given panel and conceals the slats of an adjacently overlying panel under the slats of said given panel; said moving means including:

(i) a knob defining an axis therethrough, said knob being rotatable about said axis between a plurality of N positions; and (ii) N−1 cam disks, each cam disk being secured to said knob for rotation therewith, being associated with a respective one of said movable panels, and defining a cam pin disposed in said cam slot of a respective movable panel;

each said cam pin being fixedly disposed on a respective one of said cam disks for movement therewith, and each of said cam slots being configured and dimensioned to cooperate with the cam pin disposed therein such that rotation of said knob, and hence said cam disk, causes longitudinal movement of one of said movable panels at a given time while simultaneously restraining the remaining movable panels against longitudinal movement therewith;

(C) means for generating sounds according to the setting of a switch means; and (D) switch means secured to said knob for rotation therewith, the orientation of said knob, and hence said switch means, determining which sound will be generated by said sound generating means;

whereby rotation of said knob controls and correlates both the image to be displayed and the sounds to be heard.

* * * * *